US008239192B2

(12) United States Patent
Kovesi et al.

(10) Patent No.: US 8,239,192 B2
(45) **Date of Patent: *Aug. 7, 2012**

(54) TRANSMISSION ERROR CONCEALMENT IN AUDIO SIGNAL

(75) Inventors: Balazs Kovesi, Lannion (FR); Dominique Massaloux, Perros-Guirec (FR); David Deleam, Perros Guirec (FR)

(73) Assignee: France Telecom, Paris (FR)

( * ) Notice: Subject to any disclaimer, the term of this patent is extended or adjusted under 35 U.S.C. 154(b) by 378 days.

This patent is subject to a terminal disclaimer.

(21) Appl. No.: 12/462,763

(22) Filed: Aug. 7, 2009

(65) Prior Publication Data

US 2010/0070271 A1 Mar. 18, 2010

Related U.S. Application Data

(63) Continuation of application No. 10/363,783, filed as application No. PCT/FR01/02747 on Sep. 5, 2001, now Pat. No. 7,596,489.

(30) Foreign Application Priority Data

Sep. 5, 2000 (FR) ..... 00 11285

(51) Int. Cl.
*G10L 19/00* (2006.01)

(52) U.S. Cl. ..... 704/219; 704/265; 704/225

(58) Field of Classification Search ..... 704/211, 704/200, 219, 220–225, 214, 215, 205–210, 704/265, 258, 260, 270
See application file for complete search history.

(56) References Cited

U.S. PATENT DOCUMENTS

| | | | | |
|---|---|---|---|---|
| 5,574,825 | A | 11/1996 | Chen et al. | |
| 5,717,822 | A | 2/1998 | Chen | |
| 5,732,389 | A * | 3/1998 | Kroon et al. | 704/223 |
| 5,884,010 | A | 3/1999 | Chen et al. | |
| 6,188,980 | B1 | 2/2001 | Thyssen | |
| 6,240,386 | B1 | 5/2001 | Thyssen et al. | |
| 6,449,590 | B1 | 9/2002 | Gao | |
| 6,556,966 | B1 | 4/2003 | Gao | |
| 7,050,968 | B1 | 5/2006 | Murashima | |
| 7,092,885 | B1 | 8/2006 | Yamaura | |
| 7,590,525 | B2 * | 9/2009 | Chen | 704/211 |

FOREIGN PATENT DOCUMENTS

CA 2112145 6/1994

(Continued)

OTHER PUBLICATIONS

Combescure, P. et al. "A 16, 24, 32 KBIT/S Wideband Speech Codec Based on Atcelp", IEEE, pp. 5-8 (1999).

(Continued)

*Primary Examiner* — Huyen X. Vo
(74) *Attorney, Agent, or Firm* — Cozen O'Connor

(57) ABSTRACT

A method of concealing transmission error in a digital audio signal, wherein a signal that has been decoded after transmission is received, the samples decoded while the transmitted data is valid are stored, at least one short-term prediction operator and one long-term prediction operator are estimated as a function of stored valid samples, and any missing or erroneous samples in the decoder signal are generated using the estimated operators. The energy of the synthesized signal that is thus generated is controlled by means of a gain that is computed and adapted sample by sample.

17 Claims, 3 Drawing Sheets

FOREIGN PATENT DOCUMENTS

| | | | |
|---|---|---|---|
| FR | 2 774 827 | | 8/1999 |
| JP | 07-311596 | A | 11/1995 |
| JP | 7311596 | | 11/1995 |
| JP | 09-120297 | A | 5/1997 |
| JP | 9120297 | | 5/1997 |
| WO | WO 99/40573 | | 8/1999 |
| WO | WO 99/40573 | | 8/2009 |

OTHER PUBLICATIONS

Erdol, N. et al. "Recovery of Missing Speech Packets Using the Short-Time Energy and Zero-Crossing Measurements", IEEE, vol. 1, No. 3, pp. 295-303 (1993).

* cited by examiner

TRANSMISSION ERROR CONCEALMENT IN AUDIO SIGNAL

CROSS REFERENCE TO RELATED APPLICATIONS

This is a continuation of U.S. patent application Ser. No. 10/363,783 filed on Jul. 7, 2003, now U.S. Pat. No. 7,596,489, which is a national phase of international application No. PCT/FR01/02747 filed on Sep. 5, 2001. Priority is claimed for this invention and application, corresponding applications having been filed in France Application No. 00/1285, filed on Sep. 5, 2000, the content of which is incorporated herein by reference in its entirety.

BACKGROUND OF THE INVENTION

1. Field of the Invention

The present invention relates to techniques for concealing consecutive transmission errors in transmission systems using digital coding of any type on a speech and/or sound signal.

It is conventional to distinguish between two major categories of coder:

"time" coders which compress digitized signal samples on a sample-by-sample basis (as applies to pulse code modulation (PCM) and to adaptive differential PCM (ADPCM) [DAUMER] [MAITRE], for example); and parametric coders which analyze successive frames of signal samples for coding in order to extract from each frame a certain number of parameters which are then coded and transmitted (as applies to vocoders [TREMAIN], IMBE coders [HARWICK], or transform coders [BRANDENBURG])

There also exist intermediate categories which associate the coding of representative parameters as performed by parametric coders, with the coding of a residual time waveform. To simplify, such coders can be included within the category of parametric coders.

This category includes predictive coders and in particular the family of coders performing analysis by synthesis such as RPE-LTP ([HELLWIG]) or code excited linear prediction (CELP) ([ATAL]).

For all such coders, the coded values are subsequently transformed into a binary string which is transmitted over a transmission channel. Depending on the quality of the channel and on the type of transport, disturbances may affect the signal as transmitted and produce errors on the binary string received by the decoder. These errors may occur in isolated manner in the binary string, but very frequently they occur in bursts. It is then a packet of bits corresponding to an entire portion of the signal which is erroneous or not received. This type of problem is to be encountered for example in transmission on mobile telephone networks. It is also to be encountered in transmission over packet-switched networks, and in particular networks of the Internet type.

When the transmission system or the modules dealing with reception make it possible to detect that the data being received is highly erroneous (for example in mobile networks), or when a block of data is not received (e.g. as occurs in packet transmission systems), then procedures for concealing errors are implemented. Such procedures enable the decoder to extrapolate missing signal samples on the basis of the available signals and of data coming from earlier frames, and possibly also from frames that follow the zones that have been lost.

Such techniques have already been implemented, mainly for parametric coders (techniques for recovering erased frames). They make it possible to limit to a very large extent the subjective degradation of the signal perceived at the decoder in the presence of erased frames. Most of the algorithms that have been developed rely on the techniques used by the coder and the decoder, and they thus constitute an extension of the decoder.

A general object of the invention is to improve the subjective quality of a speech signal as played back by a decoder in any system for compressing speech or sound, in the event that a set of consecutive coded data items have been lost due to poor quality of a transmission channel or following the loss or non-reception of a packet in a packet transmission system.

To this end, the invention proposes a technique enabling successive transmission errors (error packets) to be concealed regardless of the coding technique used, and the technique proposed is suitable for use, for example, in time coders whose structure, a priori, lends itself less well to concealing packets of errors.

2. Description of the Related Art

Most coding algorithms of the predictive type propose techniques for recovering erased frames ([GSM-FR], [REC G.723.1A], [SALAMI], [HONKANEN], [COX-2], [CHEN-2], [CHEN-3], [CHEN-4], [CHEN-5], [CHEN-6], [CHEN-7], [KROON], [WATKINS]). The decoder is informed that an erased frame has occurred in one way or another, for example in the case of radio mobile systems by a frame-erasure flag being forwarded from the channel decoder. Devices for recovering erased frames seek to extrapolate the parameters of an erased frame on the basis of the most recent frame(s) that is/are considered as being valid. Some of the parameters manipulated or coded by predictive coders present a high degree of correlation between frames (this applies, for example, both to short-term predictive parameters also referred to as "linear predictive coding" (LPC) (see [RABINER]) which represent the spectral envelope, and to long-term prediction parameters for voiced sounds). Because of this correlation, it is much more advantageous to reuse the parameters of the most recent valid frame for the purpose of synthesizing the erased frame than it is to use parameters that are erroneous or random.

For CELP coding (refer to [RABINER]), the parameters of the erased frame are conventionally obtained as follows:

- the LPC filter is obtained from the LPC parameters of the most recent valid frame, either by copying the parameters or after applying a certain amount of damping (cf. G723.1 coder [REC G.723.1A]);
- voicing is detected to determine the degree of signal harmonicity in the erased frame ([SALAMI]) where such detection takes place as follows:
  - for a non-voiced signal:
    - an excitation signal is generated in random manner (randomly drawing a code word and using lighted damped past excitation gain [SALAMI], randomly selecting from within the past excitation [CHEN], using transmitted codes that are possibly completely erroneous [HONKANEN], . . . );
  - for a voiced signal:
    - the LTP delay is generally the delay calculated for the preceding frame, possibly accompanied by a small amount of "jitter" ([SALAMI]), where LTP gain is taken to be very close to 1 or being equal to 1. The excitation signal is limited to long-term prediction performed on the basis of past excitation.

In all of the examples mentioned above, the procedures for concealing erased frames are strongly linked to the decoder and make use of decoder modules such as the signal synthesis module. They also use intermediate signals that are available within the decoder such as the past excitation signal as stored while processing valid frames preceding the erased frames.

Most of the methods used for concealing the errors produced by packets lost during the transport of data coded by time type coders rely on techniques for substituting waveforms such as those described in [GOODMAN], [ERDÖL], [AT&T]. Methods of that type reconstitute the signal by selecting portions of the signal as decoded prior to the period that has been lost and they do not make any use of synthesis models. Smoothing techniques are also implemented to avoid the artifacts that would otherwise be produced by concatenating different signals.

For transform coders, the techniques for reconstructing erased frames also rely on the structure of the coding used: algorithms such as [PICTEL, MAHIEUX-2] rely on regenerating transform coefficients that have been lost on the basis of the values taken by those coefficients prior to erasure.

The method described in [PARIKH] can be applied to any type of signal; it relies on constructing a sinusoidal model on the basis of the valid signal as decoded prior to erasure, in order to generate the missing signal portion.

Finally, there exists a family of techniques for concealing erased frames that have been developed together with the channel coding. Those methods, such as that described in [FINGSCHEIDT] make use of information provided by the channel decoder, e.g. information concerning the degree of reliability of the parameters received. They are fundamentally different from the present invention which does not presuppose the existence of a channel coder.

The prior art that can be considered as being the closest to the present invention is that described in [COMBESCURE], which proposes a method of concealing erased frames equivalent to that used in CELP coders for a transform coder. The drawbacks of the method proposed lie in the introduction of audible spectral distortion (a "synthetic" voice, parasitic resonances, . . . ), due specifically to the use of poorly-controlled long-term synthesis filters (a single harmonic component in voiced sounds, excitation signal generation restricted to the use of portions of the past residual signal). In addition, energy control is performed in [COMBESCURE] at excitation signal level, with the energy target for said signal being kept constant throughout the duration of the erasure, and that also gives rise to troublesome artifacts.

SUMMARY OF THE INVENTION

The invention makes it possible to conceal erased frames without marked distortion at higher error rates and/or for longer erased intervals.

Specifically, the invention provides a method of concealing transmission error in a digital audio signal in which a signal that has been decoded after transmission is received, the samples decoded while the transmitted data is valid are stored, at least one short-term prediction operator and one long-term prediction operator are estimated as a function of stored valid samples, and any missing or erroneous samples in the decoder signal are generated using the operators estimated in this way.

In a particularly advantageous first aspect of the invention, the energy of the synthesized signal as generated in this way is controlled by means of a gain that is computed and adapted sample by sample.

This contributes in particular to improving the performance of the technique over erasure zones of longer duration.

In particular, the gain for controlling the synthesized signal is calculated as a function of at least one of the following parameters: energy values previously stored for the samples corresponding to valid data; the fundamental period for voiced sounds; and any parameter characteristic of frequency spectrum.

Also advantageously, the gain applied to the synthesized signal decreases progressively as a function of the duration during which synthesized samples are generated.

Also in preferred manner, steady sounds and non-steady sounds are distinguished in the valid data, and gain adaptation relationships are implemented for controlling the synthesized signal (e.g. decreasing speed) that differ firstly for samples generated following valid data corresponding to steady sounds and secondly for samples generated following valid data corresponding to non-steady sounds.

In another aspect of the invention that is independent, the content of the memories used for decoding processing is updated as a function of the synthesized samples generated.

In this way, firstly any loss of synchronization between the coder and the decoder is limited (see paragraph 5.1.4 below), and secondly sudden discontinuities are avoided between the erased zone as reconstructed by the invention and the samples that follow said zone.

In particular, the synthesized samples are subjected at least in part to coding analogous to that implemented at the transmitter, optionally followed by a decoding operation (possibly a partial decoding operation), with the data that is obtained serving to regenerate the memories of the decoder.

In particular, this coding and decoding operation which may possibly be a partial operation can advantageously be used for regenerating the first erased frame since it makes it possible to use the content of the memories of the decoder prior to the interruption, in the event that these memories contain information not supplied by the latest decoded valid samples (for example in the case of add-overlap transform coders, see paragraph 5.2.2.2.1 point 10).

According to another different aspect of the invention, an excitation signal is generated for input to the short-term prediction operator, which signal in a voiced zone is the sum of a harmonic component plus a weakly harmonic or non-harmonic component, and in a non-voiced zone is restricted to a non-harmonic component.

In particular, the harmonic component is advantageously obtained by implementing filtering by means of the long-term prediction operator applied to a residual signal computed by implementing inverse short-term filtering on the stored samples.

The other component is determined using a long-term prediction operator to which pseudo-random disturbances may be applied (e.g. gain or period disturbance).

In a particularly preferred manner, in order to generate a voiced excitation signal, the harmonic component is limited to low frequencies of the spectrum, while the other component is limited to high frequencies.

In yet another aspect, the long-term prediction operator is determined from stored valid frame samples with the number of samples used for this estimation varying between a minimum value and a value that is equal to at least twice the fundamental period estimated for voiced sound.

Furthermore, the residual signal is advantageously modified by non-linear type processing in order to eliminate amplitude peaks.

Also, in another advantageous aspect, voice activity is detected by estimating noise parameters when the signal is considered as being non-active, and the synthesized signal parameters are caused to tend towards the parameters for the estimated noise.

Also in preferred manner, the noise spectrum envelope of valid decoded samples is estimated and a synthesized signal is generated that tends towards a signal possessing the same spectrum envelope.

The invention also provides a method of processing sound signals, characterized in that discrimination is implemented between speech and music sounds, and when music sounds are detected, a method of the above-specified type is implemented without estimating a long-term prediction operation, the excitation signal being limited to a non-harmonic component obtained by generating uniform white noise, for example.

The invention also provides apparatus for concealing transmission error in a digital audio signal, the apparatus receiving a decoded signal as input from a decoder which generates missing or erroneous samples in the decoded signal, the apparatus being characterized in that it comprises processor means suitable for implementing the above-specified method.

The invention also provides a transmission system comprising at least one coder, at least one transmission channel, a module suitable for detecting that transmitted data has been lost or is highly erroneous, at least one decoder, and apparatus for concealing errors which receives the decoded signal, the system being characterized in that the error-concealing apparatus is apparatus of the above-specified type.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Other characteristics and advantages of the invention appear further from the following description which is purely illustrative and non-limiting, and which should be read with reference to the accompanying drawings, in which.

DETAILED DESCRIPTION OF THE PREFERRED EMBODIMENTS

5.1 The Principles of a Possible Embodiment

Figure 1:
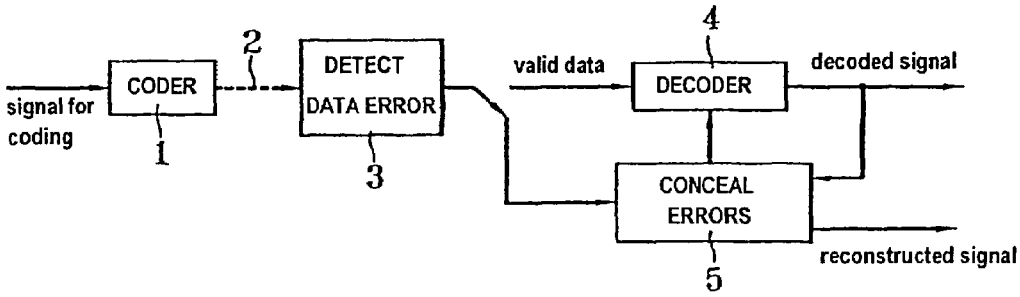
FIG. 1 is a block diagram showing a transmission system constituting a possible embodiment of the invention.

FIG. 1 shows apparatus for coding and decoding a digital audio signal, the apparatus comprising a coder 1, a transmission channel 2, a module 3 serving to detect that transmitted data has been lost or is highly erroneous, a decoder 4, and a module 5 for concealing errors or lost packets in a possible implementation of the invention.

It should be observed that in addition to receiving information that data has been erased, the module 5 also receives the decoded signal during valid periods and it forwards signals to the decoder that are used for updating it.

More precisely, the processing implemented by the module 5 relies on:

1. storing samples as decoded while the transmitted data is valid (process 6):

2. during an erased data block, synthesizing samples corresponding to the lost data (process 7);

3. once transmission is reestablished, smoothing between the synthesized samples produced during the erased period and the decoder samples (process 8); and 4. updating the memories of the decoder (process 9) (which updating takes place either while generating the erased samples, or when transmission is reestablished).

5.1.1 During a Valid Period

After decoding valid data, the decoder sample memory is updated and it contains a number of samples that is sufficient for regenerating possible subsequent erased periods. Typically, about 20 milliseconds (ms) to 40 ms of signal are stored. The energy of the valid frames is also computed and the memory stores values corresponding to the energy levels of the most recent processed valid frames (typically over a period of about 5 seconds (s)).

5.1.2 During a Block of Erased Data

Figure 3:
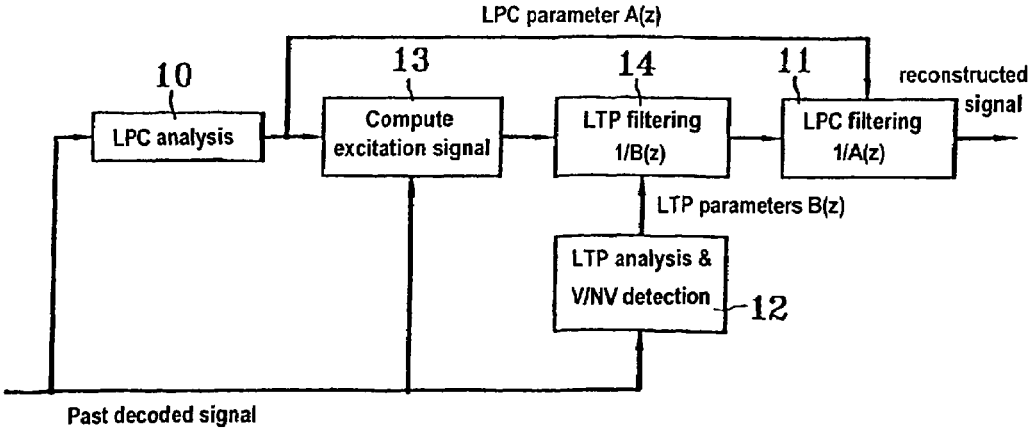

The following operations are performed, as shown in FIG. 3:

1. The Current Spectral Envelope is Estimated:

This spectral envelope is computed in the form of an LPC filter [RABINER] [KLEIJN]. Analysis is performed by conventional methods ([KLEIJN]) after windowing samples stored in a valid period. Specifically, LPC analysis is performed (step 10) to obtain the parameters of a filter A(z), whose inverse is used for LPC filtering (step 11). Since the coefficients as computed in this way are not for transmission, this can be implemented using high order analysis, thus making it possible to achieve good performance on music signals.

2. Detecting Voiced Sounds and Computing LTP Parameters:

A method of detecting voiced sound (process 12, FIG. 3: V/NV detection for "voiced/non-voiced" detection) is used on the most recent stored data. For example, this can be done using normalized correlation ([KLEIJN]), or the criterion presented in the implementation described below.

When the signal is declared to be voiced, the parameters that enable a long-term synthesis filter to be generated are computed, also referred to as an LTP filter ([KLEIJN]) (FIG. 3: LTP analysis, with the computed inverse LTP filter being defined by B(Z)). Such a filter is generally represented by a gain and by a period corresponding to the fundamental period. The precision of the filter can be improved by using fractional pitch or by using a multi-coefficient structure [KROON].

When the signal is declared to be non-voiced, a particular value is given to the LTP synthesis filter (see paragraph 4).

It is particularly advantageous in this estimation of the LTP synthesis filter to restrict the zone analyzed to the end of the period preceding erasure. The length of the analysis window varies between a minimum value and a value associated with the fundamental period of the signal.

3. Computing a Residual Signal:

A residual signal is computed by inverse LPC filtering (process 10) applied to the most recent stored samples. This signal is then used to generate an excitation signal for application to the LPC synthesis filter 11 (see below).

4. Synthesizing the Missing Samples:

The replacement samples are synthesized by introducing an excitation signal (computed at 13 on the basis of the signal output by the inverse LPC filter) in the LPC synthesis filter 11 (1/A(z)) as computed at 1. This excitation signal is generated in two different ways depending on whether the signal is voiced or not voiced:

4.1 In a Voiced Zone:

The excitation signal is the sum of two signals, one highly harmonic component, and the other being less harmonic or not harmonic at all.

The highly harmonic component is obtained by LTP filtering (processor module 14) using the parameters computed at 2, on the residual signal mentioned at 3.

The second component may be obtained likewise by LTP filtering, but it is made non-periodic by random modifications to the parameters, by generating a pseudo-random signal.

It is particularly advantageous to limit the passband of the first component to low frequencies of the spectrum. Similarly, it is advantageous to limit the second component to higher frequencies.

4.2 In a Non-Voiced Zone:

When the signal is not voiced, a non-harmonic excitation signal is generated. It is advantageous to use a method of generation that is similar to that used for voiced sounds, with variations of parameters (period, gain, signs) enabling it to be made non-harmonic.

4.3 Controlling the Amplitude of the Residual Signal:

When the signal is not voiced, or is weakly voiced, the residual signal used for generating excitation is processed so as to eliminate amplitude peaks that are significantly above the average.

5. Controlling the Energy of the Synthesized Signal

The energy of the synthesized signal is controlled using gain as computed and matched sample by sample. When the period of an erasure is relatively lengthy, it is necessary to reduce the energy of the synthesized signal progressively. The relationship for matching gain is computed as a function of various parameters: energy values stored prior to erasure (see 1); fundamental period; and local steadiness of the signal at the time of interruption.

If the system has a module that enables steady sounds (such as much music) to be distinguished from non-steady sounds (such as speech), then different adaptation relationships can also be used.

When using transform coders with addition and overlap, the first half of the memory of the last properly-received frame contains information that is very accurate concerning the first half of the first lost frame (its weight in the addition-and-overlap is greater than that of the current frame). This information can also be used for computing the adaptive gain.

6. Variation in the Synthesis Procedure Over Time:

In the event of a relatively long erasure period, the synthesis parameters may also be caused to vary. If the system is coupled to apparatus for detecting voice activity with noise parameter estimation (such as [REC-G.723.1A], [SALAMI-2], [BENYASSINE]), it is particularly advantageous to cause the parameters for generating the signal for reconstruction to tend towards those of the estimated noise: in particular, in terms of the spectral envelope (interpolation of the LPC filter with that for estimated noise, interpolation coefficients varying over time so as to obtain the noise filter), and concerning energy (a level which varies progressively towards the noise energy level, e.g. by windowing).

5.1.3 When Transmission is Reestablished

When transmission is reestablished, it is particularly important to avoid sudden breaks between the erased period which has been reconstructed using the techniques defined in the preceding paragraphs, and the following periods during which all of the transmitted information is available for decoding the signal. The present invention performs weighting in the time domain with interpolation between the replacement samples that precede communication being reestablished and valid samples as decoded following the erased period. This operation is independent, a priori, of the type of coder used.

With transform coders using addition and overlap, this operation is common with updating memories as described in the following paragraph (see embodiment).

5.1.4 Updating Decoder Memories

When valid samples start to be decoded after an erased period, degradation can occur in the event of the decoder using the data as normally produced during the preceding frames and stored in memory. It is important to update these memories cleanly in order to avoid artifacts.

This is particularly important for coding structures that make use of recursive methods, since for any one sample or sample sequence, they make use of information obtained by decoding preceding samples. This applies for example to predictions ([KLEIJN]) which enable redundancy to be extracted from the signal. Such information is normally available both at the coder, which for this purpose needs to have implemented a form of local decoding on these preceding samples, and at the remote decoder which is used on reception. Once the transmission channel has been disturbed and the remote decoder no longer has the same information as the local decoder present on transmission, then desynchronization arises between the coder and the decoder. With highly recursive coding systems, this desynchronization can give rise to audible degradation that can last for a long time and can even grow over time if there are instabilities in the structure. Under such circumstances, it is therefore important to make efforts to resynchronize the coder with the decoder, i.e. to make as close as possible an estimate in the decoder memories of the content of the coder memories. Nevertheless, resynchronization techniques depend on the coding structure used. One such structure is described below based on a principle that is general in the context of the present application, but of complexity that is potentially large.

One possible method consists in introducing in the decoder on reception a coding module of the same type as that used on transmission, thus making it possible to code and decode signal samples produced by the techniques mentioned in the preceding paragraph during erased periods. In this way, the memories needed for decoding the following samples are filled out with data that, a priori, is close to that which has been lost (providing there is a degree of steadiness during the erased period). In the event that this assumption of steadiness is not satisfied, e.g. after a lengthy erased period, then in any event information is not available making it possible to do any better.

It is not generally necessary to perform complete coding of the samples, and it is possible to concentrate solely on the modules needed for updating the memories.

This updating can be performed at the time the replacement samples are produced, thereby spreading complexity over the entire erasure zone, but it is cumulative with the procedure described above for performing synthesis.

When the coding structure makes it possible, it is also possible to limit the above procedure to an intermediate zone at the beginning of the valid data period following an erased period, with the updating procedure then being additional to the decoding operation.

5.2 Description of Particular Embodiments

Various possible particular embodiments are described below. Particular attention is given to transform coders of the TDAD or TCDM type ([MAHIEUX]).

5.2.1 Description of the Apparatus

A digital transform coding/decoding system of the TDAC type.

Broadened band coder (50 hertz (Hz) to 7000 Hz) at 24 kilobits per second (kb/s) or 32 kb/s.

Frame 20 ms long (320 samples).

Figure 4:
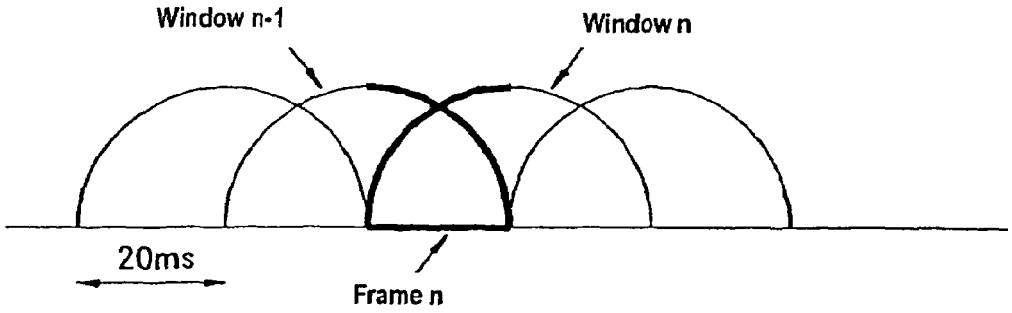
FIGS. 4 to 6 are diagrams showing the windows used with the error concealment method constituting a possible implementation of the invention.
Figure 5:
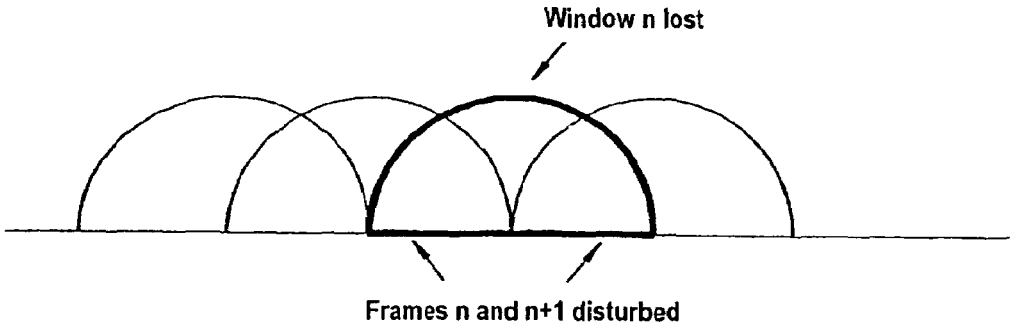

Windows 40 ms long (640 samples) with adding and overlap of 20 ms. A binary frame contains the coded parameters obtained by the TDAC transform on a window. After these parameters have been decoded, by performing the inverse TDAC transform, an output frame is obtained that is 20 ms long, which frame is the sum of the second half of the preceding window and the first half of the current window. In FIG. 4, the two portions of windows used for reconstructing frame n (in time) is drawn using bold lines. Thus, a lost binary frame interferes with reconstructing two consecutive frames (the present frame and the following frame, FIG. 5). However, by correctly replacing lost parameters, it is possible to recover the portions of information coming from the preceding frame and the following frame (FIG. 6) in order to reconstruct both frames.

5.2.2 Implementation

Figure 2:
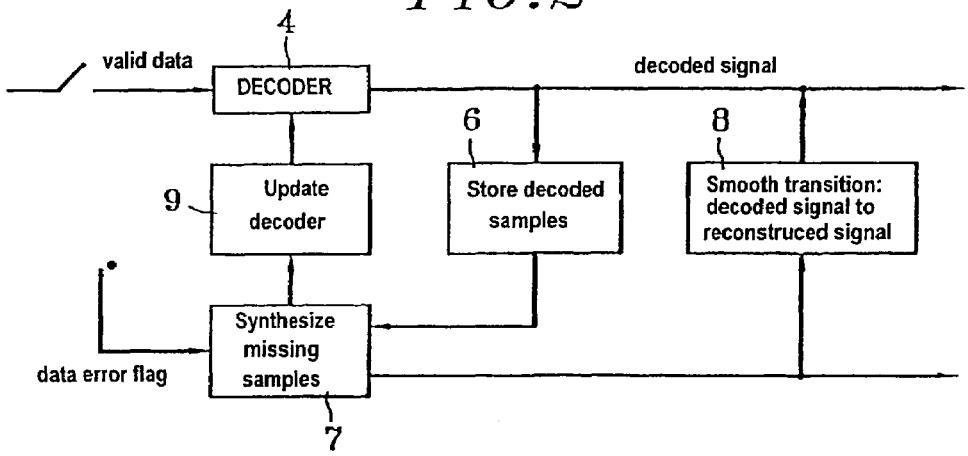
FIGS. 2 and 3 are block diagrams showing an implementation of a possible embodiment of the invention.

All of the operations described below are implemented on reception, as shown in FIGS. 1 and 2, either within the module for concealing erased frames in communication with the decoder, or else in the decoder itself (updating memories in the decoder).

5.2.2.1 During a Valid Period

In corresponding with paragraph 5.1.2, the decoded sample memory is updated. This memory is used for LPC and LTP analyses of the past signal in the event of a binary frame being erased. In the example described herein, LPC analysis is performed on a signal period of 20 ms (320 samples). In general, LTP analysis requires more samples to be stored. In this example, in order to be able to perform LTP analysis properly, the number of samples stored is equal to twice the maximum pitch value. For example, if the maximum pitch value MaxPitch is fixed at 320 samples (50 Hz, 20 ms), then the last 640 samples are stored (40 ms of signal). The energy of valid frames is also computed and the results stored in a circular buffer having a length of 5 s. When it is detected that a frame has been erased, the energy of the most recent valid frame is compared with the maximum and the minimum in the circular buffer in order determine its relative energy.

5.2.2.2 During an Erased Data Block

When a binary frame is lost, two different circumstances are distinguished:

5.2.2.2.1 First Binary Frame Lost after a Valid Period

Figure 6:
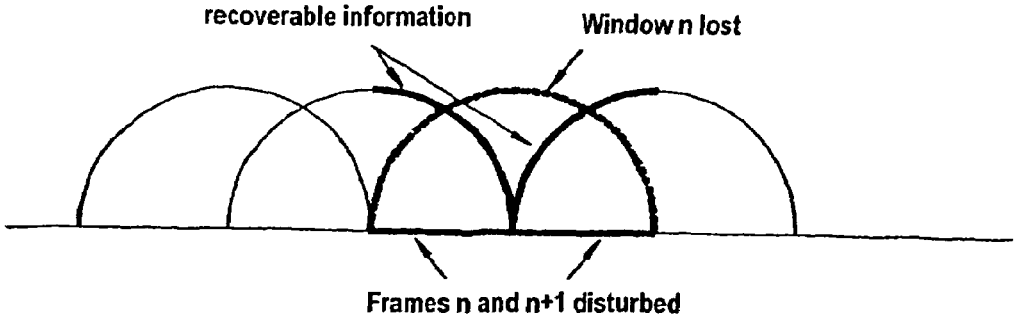

Initially, the stored signal is analyzed to estimate the parameters of the model used for synthesized the regenerated signal. This model subsequently makes it possible to synthesize 40 ms of signal, which corresponds to the lost 40 ms window. By implementing the TDAC transform followed by the inverse TDAC transform on the synthesized signal (without coding—decoding parameters), an output signal of 20 ms duration is obtained. By means of these TDAC and inverse TDAC operations, use is made of information coming from the preceding window that was received properly (see FIG. 6). Simultaneously, the memories of the decoder are updated. As a result, the following binary frame, if it is properly received, can itself be decoded normally, and the decoded frames will automatically be synchronized (FIG. 6).

The operations to be performed are as follows:

1. Windowing the stored signal. For example it is possible to use an asymmetrical 20 ms Hamming window.

2. Computing the self-correlation function of the windowed signal.

3. Determining the coefficients of the LPC filter. To do this, it is conventional to use the iterative Levinson-Durbin algorithm. Analysis order may be high, particularly when the coder is used for coding music sequences.

4. Detecting voicing and long-term analysis of the stored signal for possible modeling of signal periodicity (voiced sounds). In the implementation described, the inventors have restricted estimating the fundamental period Tp to integer values, and an estimate of the degree of voicing is computed in the form of a correlation coefficient MaxCorr (see below) evaluated for the selected period. This gives Tm=max(T, Fs/200), where Fs is the sampling frequency, and thus Fs/200 samples corresponds to a duration of 5 ms. To obtain a better model of variation in the signal at the end of the preceding frame, correlation coefficients Corr(T) are computed corresponding to a delay T by using only 2×Tm samples at the end of the stored signal:

$$\mathrm{Corr}(T) = \frac{2\sum_{i=Lmem-2T_m+T}^{Lmem-1} m_i m_{i-T}}{\sum_{i=Lmem-2T_m}^{Lmem-1} m_i^2 + \sum_{i=Lmem-2T_m+T}^{Lmem-1-T} m_i^2}$$

where $m_0 \ldots m_{Lmem-1}$ is the previously decoded signal memory. From this formula, it can be seen that the length of the memory $L_{mem}$ needs to be at least twice the maximum value of the fundamental period (also referred to as "pitch") MaxPitch.

The minimum value of the fundamental period MinPitch is also fixed to correspond to a frequency of 600 Hz (26 samples of Fs=16 kHz).

Corr(T) is computed for T=MaxPitch. If T' is the smallest delay such that Corr(T')<0 (thus eliminating very short term correlation), then a search is made for MaxCorr which is the maximum of Corr(T) for T'<T<=MaxPitch. This gives Tp equal to the period corresponding to MaxCorr (Corr(Tp)=MaxCorr). A search is also made for MaxCorrMP, the maximum of Corr-T) for T'<T<0.75×MinPitch. If Tp<MinPitch or maxCorrMP>0.7×MaxCorr, and if the energy level of the last valid frame is relatively low, then it is decided that the frame is not voiced, since if LTP prediction were to be used there would be a risk of obtaining very troublesome resonance at high frequency. The selected pitch is Tp=MaxPitch/2, and the correlation coefficient MaxCorr is set at a low value (0.25).

The frame is also considered as being non-voiced when more than 80% of its energy is concentrated in the most recent MinPitch samples. It then corresponds to the beginning of speech, but the number of samples is not sufficient for estimating any fundamental period, so it is better to process the frame as being non-voiced, and even to decrease the energy level of the synthesized signal more quickly (to flag this, a flag DiminFlag is set to 1).

When MaxCorr>0.6, a check is made to see whether a multiple of the fundamental period has been found (i.e. 4, 3, or 2 times the fundamental period). To do this, a search is made for a local correlation maximum around Tp/4, Tp/3, and Tp/2. The position of the maximum is written $T_1$, and MacCorrL=Corr($T_1$). If $T_1$>MinPitch and MaxCorrL>0.75×MaxCorr, then $T_1$ is selected as the new fundamental period.

If Tp is less than MaxPitch/2, it is possible to verify whether this is genuinely a voiced frame by making a search for a local maximum in the correlation around 2×Tp (Tpp) and verifying whether Corr(Tpp)>0.4. If Corr(Tpp)<0.4, and if the energy level of the signal is decreasing, then DiminFlag is set to 1 and the value of MaxCorr is decreased, else a search is made for the following local maximum between the present Tp and MaxPitch.

Another voicing criterion consists in verifying whether the signal retarded by the fundamental period has the same sign as the non-retarded signal in at least two-thirds of all cases.

This is verified over a duration equal to the maximum of 5 ms and 2×Tp.

A check is also made to verify whether the energy level of the signal is or is not tending to diminish, if it is tending to diminish, then DiminFlag is set to 1 and the value of MaxCorr is caused to decrease as a function of the degree of diminution.

A decision concerning voicing also takes account of the energy level of the signal. If energy level is strong, then the value of MaxCorr is increased, thus making it more probable that the frame will be found to be voiced. In contrast, if the energy level is very low, then the value of MaxCorr is diminished.

Finally, the decision concerning voicing is taken as a function of the value of MaxCorr: a frame is not voiced if and only if MaxCorr<0.4. The fundamental period Tp of a non-voiced frame is bounded, and it must be less than or equal to MaxPitch/2.

5. The residual signal is computed by inverse LPC filtering of the last stored samples. This residual signal is stored in the memory ResMem.

6. The energy of the residual signal is equalized. When the signal is not voiced or is weakly voiced (MaxCorr<0.7), the energy of the residual signal stored in ResMem may change suddenly from one portion to another. Repeating this excitation would give rise to highly disagreeable periodic disturbance in the synthesized signal. To avoid that, a check is made to ensure that there is no large amplitude peak present in the excitation of a weakly voiced frame. Since the excitation is constructed on the basis of the last Tp samples of the residual signal, this vector of Tp samples is processed. The method used in the present example is as follows:

The mean MeanAmpl of the absolute values of the last Tp samples of the residual signal is computed.

If the vector of samples for processing contains n zero crossings, then it is subdivided into n+1 sub-vectors, with the sign of the signal in each sub-vector then being invariant.

A search is made for the maximum amplitude MaxAmplSv of each sub-vector. If MaxAmplSv>1.5×MeanAmpl, then the sub-vector is multiplied by 1.5×ManAmpl/MaxAmplSv.

7. An excitation signal of length 640 samples is prepared corresponding to the length of the TDAC window. Two cases are distinguished depending on voicing:

The excitation signal is the sum of two signals, a highly harmonic component band limited to the low frequencies of the spectrum excb, and at least one other harmonic limited to the higher frequencies exch.

The highly harmonic component is obtained by third order LTP filtering of the residual signal:

$$excb(i)=0.15\times exc(i-Tp-1)+0.7\times exc(i-Tp)+0.15\times exc(i-Tp+1)$$

The coefficients [0.15, 0.7, 0.15] correspond to a low pass FIR filter having 3 decibels (dB) attenuation at Fs/4.

The second component is also obtained by LTP filtering that has been made non-periodic by random modification of its fundamental period Tph. Tph is selected as the integer portion of a random real value Tpa. The initial value of Tpa is equal to Tp and then it is modified sample by sample by adding a random value in the range [−0.5, 0.5]. In addition, this LTP filtering is combined with IIR high pass filtering:

$$exch(i)=-0.635\times(exc(i-Tph-1)+exc(i-Tph+1))+0.1182\times exc(i-Tph)-0.9926\times exch(i-1)-0.7679\times exch(i-2)$$

The voiced excitation is then the sum of these two components:

$$exc(i)=excb(i)+exch(i)$$

For a non-voiced frame, the excitation signal exc is obtained likewise by third order LTP filtering using the coefficients [0.15, 0.7, 0.15] but it is made non-periodic by increasing the fundamental period by a value equal to 1 once every ten samples, with sign being inverted with a probability of 0.2.

8. Replacement samples are synthesized by introducing the excitation signal exc into the LPC filter as computed at 3.

9. Controlling the energy level of the synthesized signal. The energy tends progressively towards a level fixed in advance starting from the first synthesized replacement frame. This level may be defined, for example, as the energy of the lowest level output frame found during the last 5 seconds before the erasure. We have defined two gain adaptation relationships which are selected as a function of the flag DiminFlag computed at 4. The rate of energy diminution depends also on the fundamental period. There exists a more radical third adaptation law which is used when it is detected that the beginning of the generated signal does not correspond well with the original signal, as explained below (see point 11).

10. TDAC transformation of the signal synthesized at 8, as explained at the beginning of this chapter. The TDAC coefficients that have been obtained replace the TDAC coefficients that have been lost. Thereafter, by performing the inverse TDAC transform, the output frame is obtained. These operations serve three purposes:

For a first lost window, this makes use of the information in the preceding window that was correctly received and that contains half of the data needed for reconstructing the first disturbed frame (FIG. 6).

The memory of the decoder is updated for decoding the following frame (synchronization between the coder and the decoder, see paragraph 5.1.4).

It is automatically ensured that the output signal is subjected to a continuous transition (without discontinuity) when the first correctly received binary frame arrives after an erased period that has been reconstructed using the techniques described above (see paragraph 5.1.3).

11. The addition and overlap technique makes it possible to verify whether the synthesized voiced signal does indeed correspond to the original signal, since for the first half of the first lost frame, the weight of the memory of the last window to be properly received is more important (FIG. 6). Thus, by taking the correlation between the first half of the first synthesized frame and the first half of the frame obtained after the TDAD and inverse TDAC operations, it is possible to estimate similarity between the lost frame and the replacement frame. Low correlation (less than 0.65) indicates that the original signal was rather different from that obtained by the replacement method, in which case it is better to diminish the energy thereof quickly towards the minimum level.

5.2.2.2.2. Lost Frames Following the First Frame of an Erased Zone

In the preceding paragraph, points 1 to 6 relate to analyzing the decoded signal that precedes the first erased frame and that makes it possible to construct a model of said signal by synthesis (LPC and possibly LTP). For the following erased frames, the same analysis is not repeated, with the replacement of the lost signal being based on the parameters computed during the first erased frame (LPC coefficients, pitch, MaxCorr, ResMem). The only operations to be performed are thus those which correspond to synthesizing the signal and to synchronizing the decoder, with the following modifications compared with the first erased frame:

In the synthesis portion (points 7 and 8) only 320 new samples are generated since the window of the TDAC transform covers the last 320 samples generated during the preceding erased frame together with the new 320 samples.

When the period of erasure is relatively lengthy, it is important to cause the synthesis parameters to tend towards the parameters appropriate for white noise or for background noise (see point 5 in paragraph 3.2.2.2). Since the system described in this example does not have VAD/CNG, it is possible, for example, to perform one or more of the following modifications:

Progressive interpolation of the LPC filter with a flat filter in order to make the synthesized signal less colored.

Progressive increase in the value of the pitch.

In voiced mode, switching over to non-voiced mode after a certain length of time (for example once the minimum energy has been reached).

5.3 Specific Processing for Music Signals

Figure 7:
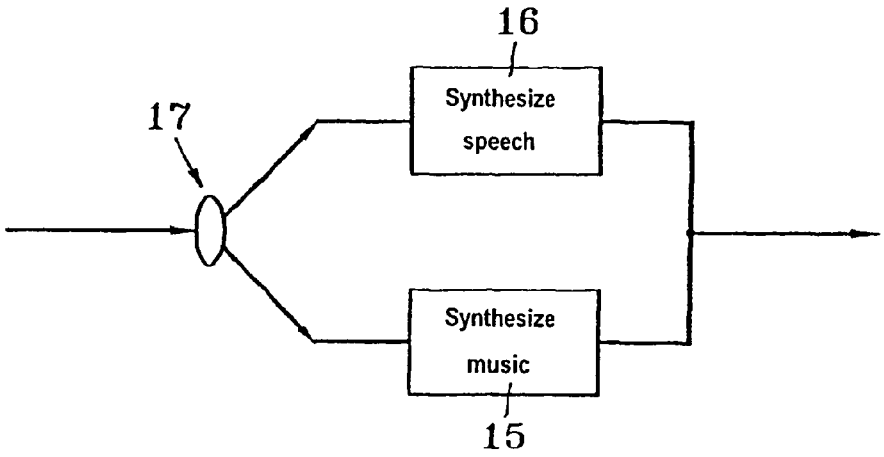
FIGS. 7 and 8 are block diagrams showing a possible embodiment of the invention for use with music signals.

If the system includes a module suitable for distinguishing speech from music, it is possible after selecting a music synthesis mode to implement processing that is specific to music signals. In FIG. 7, the music synthesis module is referenced 15, the speech synthesis module is referenced 16, and the speech/music switch is referenced 17.

Figure 8:
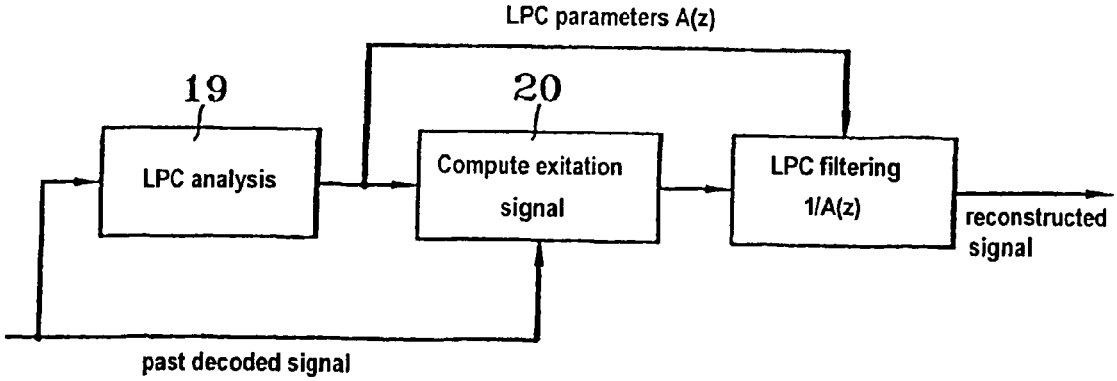

Such processing implements the following steps for example in the music synthesis module, as shown in FIG. 8:

1. Estimating the Current Spectral Envelope:

This spectral envelope is computed in the form of an LPC filter [RABINER] [KLEIJN]. Analysis is performed by conventional methods ([KLEIJN]). After windowing samples stored during a valid period, LPC analysis is implemented to compute an LPC filter A(Z) (step 19). A high order (>100) is used for this analysis in order to obtain good performance on music signals.

2. Synthesis of Missing Samples:

Replacement samples are synthesized by introducing an excitation signal into the LPC synthesis filter (1/A(z)) computed in step 19. This excitation signal, computed in step 20, is white noise of amplitude selected to obtain a signal having the same energy as the energy of the last N samples stored during a valid period. In FIG. 8, the filtering step is referenced 21.

An example of controlling the amplitude of the residual signal:

If the excitation is in the form of uniform white noise multiplied by gain, then the gain G can be calculated as follows:

Estimating the Gain of the LPC Filter:

The Durbin algorithm gives the energy of the residual signal. Given also the energy of the signal that is to be modeled, the gain $G_{LPC}$ of the LPC filter is estimated as the ratio of said two energy levels.

Computing the Target Energy:

The target energy is estimated to be equal to the energy of the last N samples stored during a valid period (N is typically less than the length of the signal used for LPC analysis).

The energy of the synthesized signal is the product of the energy of the white noise signal multiplied by $G^2$ and by $G_{LPC}$. G is selected so that this energy is equal to the target energy.

3. Controlling the Energy of the Synthesized Signal:

The same as for speech signals except that the rate at which the energy of the synthesized signal diminishes is much slower, and it does not depend on the fundamental period (which does not exist):

The energy of the synthesized signal is controlled using a computed gain that is matched sample by sample. When the erased period is relatively lengthy, it is necessary to cause the energy of the synthesized signal to lower progressively. The relationship determining how gain is matched may be computed as a function of various parameters such as the energy values stored prior to erasure, and the local steadiness of the signal at the moment of interruption.

6. How the Synthesis Procedure Varies Over Time:

This is the Same as for Speech Signals:

When periods of erasure are relatively lengthy, it is also possible to cause the synthesis parameters to vary. If the system is coupled to a device for detecting voice activity or music signals associated with noise parameter estimation (such as [REC-G.723.1A], [SALAMI-2], [BENYASSINE]), it is particularly advantageous to cause the parameters for generating the reconstructed signal to tend towards the parameters of the estimated noise: in particular in the spectral envelope (interpolating the LPC filter with the estimated noise filter, the interpolation coefficients varying over time until the noise filter has been obtained) and to the energy level (which level varies progressively towards the noise energy level, e.g. by windowing).

6. GENERAL REMARK

As will have been understood, the above-described Technique presents the advantage of being usable with any type of coder; in particular it makes it possible to remedy problems of lost packets of bits for time coders or transform coders applied to speech signals and to music signals and presenting good performance: with the present technique, the samples coming from the decoder are constituted solely by signals stored during periods when the transmitted data is valid, and this information is available regardless of the coding structure used.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

7. BIBLIOGRAPHIC REFERENCES

[AT&T] AT&T (D. A. Kapilow, R. V. Cox), "A high quality low-complexity algorithm for frame erasure concealment (FEC) with G.711", Delayed Contribution D.249 (WP 3/16), ITU, May 1999.

[ATAL] B. S. Atal and M. R. Schroder, "Predictive coding of speech signal and subjectives error criteria", IEEE Trans. on Acoustics, Speech and Signal Processing, 27: 247-254, June 1979.

[BENYASSINE] A. Benyassine, E. Shlomot and H. Y. Su, "ITU-T recommendation G.729 Annex B: A silence compression scheme for use with G.729 optimized for V.70 digital simultaneous voice and data applications", IEEE Communication Magazine, September 1997, pp. 56-63.

[BRANDENBURG] K. H. Brandenburg and M. Bossi, "Overview of MPEG audio: current and future standards for low bit rate audio coding", Journal of Audio Eng. Soc., Vol. 45-1/2, January/February 1997, pp. 4-21.

[CHEN] J. H. Chen, R. V. Cox, Y. C. Lin, N. Jayant and M. J. Melchner, "A low-delay CELP coder for the CCITT 16 kb/s speech coding standard", IEEE Journal on Selected Areas on Communications, Vol. 10-5, June 1992, pp. 830-849.

[CHEN-2] J. H. Chen, C. R. Watkins, "Linear prediction coefficient generation during frame erasure or packet loss", U.S. Pat. No. 5,574,825, EP0673018.

[CHEN-3] J. H. Chen, C. R. Watkins, "Linear prediction coefficient generation during frame erasure or packet loss", patent 884010.

[CHEN-4] J. H. Chen, C. R. Watkins, "Frame erasure or packet loss compensation method", U.S. Pat. No. 5,550, 543, EP0707308.

[CHEN-5] J. H. Chen, "Excitation signal synthesis during frame erasure or packet loss", U.S. Pat. No. 5,615,298.

[CHEN-6] J. H. Chen, "Computational complexity reduction during frame erasure of packet loss", U.S. Pat. No. 5,717, 822.

[CHEN-7] J. H. Chen, "Computational complexity reduction during frame erasure of packet loss", patent US940212435, EP0673015.

[COX] R. V. Cox, "Three new speech coders from the ITU cover a range of applications", IEEE Communication Magazine, September 1997, pp. 40-47.

[COMBESCURE] P. Combescure, J. Schnitzler, K. Ficher, R. Kirchherr, C. Lamblin, A. Le Guyader, D. Massaloux, C. Quinquis, J. Stegmann, P. Vary, "A 16, 24, 32 kib/s wide-band speech codec based on ATCELP", Proc. of ICASSP Conference, 1998.

[DAUMER] W. R. Daumer, P. Mermelstein, X. Maitre and I. Tokizawa, "Overview of the ADPCM coding algorithm", Proc. of GLOBECOM 1984, pp. 23.1.1-23.1.4.

[ERDÖL] N. Erdal, C. Castellucia, A. Zilouchian, "Recovery of missing speech packets using the short-time energy and zero-crossing measurements", IEEE Tarns. on Speech and Audio Processing, Vol. 1-3, July 1993, pp. 295-303.

[FINGSCHEIDT] T. Fingscheidt, P. Vary, "Robust speech decoding: a universal approach to bit error concealment", Proc. of ICASSP Conference, 1997, pp. 1667-1670.

[GOODMAN] D. J. Goodman, G. B. Lockhard, O. J. Wasem, W. C. Wong, "Waveform substitution techniques for recovering missing speech segments in packet voice communications", IEEE Trans. on Acoustics, Speech and Signal Processing, Vol. ASSP-34, December 1986, pp. 1440-1448.

[GSM-FR] Recommendation GSM 06.11. "Substitution and muting of lost frames for full rate speech traffic channels". ETSI/TC SMG, Ver. 3.0.1., February 1992.

[HARDWICK] J. C. Hardwick and J. S. Lim, "The application of the IMBE speech coder to mobile communications", Proc. of ICASSP Conference, 1991, pp. 249-252.

[HELLWIG] K. Hellwig, P. Vary, D. Massaloux, J. P. Petit, C. Galand and M. Rosso, "Speech codec for the European mobile radio system", GLOBECOM Conference, 1989, pp. 1065-1069.

[HONKANEN] T. Honkanen, J. Vainio, P. Kapenen, P. Haavisto, R. Salami, C. Laflamme and J. P. Adoul, "GSM enhanced full rate speech codec", Proc. of ICASSP Conference, 1997, pp. 771-774.

[KROON] P. Kroon, B. S. Atal, "On the use of pitch predictors with high temporal resolution", IEEE Trans. on Signal Processing, Vol. 39-3, March 1991, pp. 733-735.

[KROON-2] P. Kroon, "Linear prediction coefficient generation during frame erasure or packet loss", U.S. Pat. No. 5,450,449, EP0673016.

[MAHIEUX-2] Y. Mahieux, J. P. Petit, "High quality audio transform coding at 64 kbit/s", IEEE Trans. on Com., Vol. 42-11, November 1994, pp. 3010-3019.

[MAHIEUX-2] Y. Mahieux, "Dissimulation d'erreurs de transmission"[Concealing transmission errors], French patent 92/06720 filed on Jun. 3, 1992.

[MAITRE] X. Maitre, "7 kHz audio coding within 64 kbit/s", IEEE Journal on Selected Areas on Communications, Vol. 6-2, February 1988, pp. 283-298.

[PARIKH] V. N. Parikh, J. H. Chen, G. Aguilar, "Frame erasure concealment using sinusoidal analysis-synthesis and its application to MDCT-based codecs", Proc. of ICASSP Conference, 2000.

[PICTEL] PictureTel Corporation, "Detailed description of the PTC (PictureTel Transform Coder)", Contribution ITU-T, SG15/WP2/Q6, Oct. 8-9, 1996, Baltimore meeting, TD7.

[RABINER] L. R. Rabiner, R. W. Schafer, "Digital processing of speech signals", Bell Laboratories, Inc., 1978.

[REC G.723.1A] ITU-T Annex A to recommendation G.723.1 "Silence compression scheme for dual rate speech coder for multimedia communications transmitting at 5.3 & 6.3 kbit/s".

[SALAMI] R. Salami, C. Laflamme, J. P. Adoul, A. Kataoka, S. Hayashi, T. Moriya, C. Lamblin, D. Massaloux, S. Proust, P. Kroon and Y. Shoham, "Design and description of CS-ACELP: a toll quality 8 kb/s speech coder", IEEE Trans. on Speech and Audio Processing, Vol. 6-2, March 1998, pp. 116-130.

[SALAMI] R. Salami, C. Laflamme, J. P. Adoul, "ITU-T G.729 Annex A: reduced complexity 8 kb/s CS-ACELP codec for digital simultaneous voice and data", IEEE Communication Magazine, September 1997, pp. 56-63.

[TREMAIN] T. E. Tremain, "The government standard linear predictive coding algorithm: LPC 10", Speech Technology, April 1982, pp. 40-49.

[WATKINS] C. R. Watkins, J. H. Chen, "Improving 16 kb/s G.728 LD-CELP speech coder for frame erasure channels", Proc. of ICASSP Conference, 1995, pp. 241-244.

The invention claimed is:

1. A method of concealing transmission error in a digital audio signal, comprising:

generating, in response to detection of missing or erroneous samples in a transmitted signal, synthesized samples by means of at least one short-term prediction operator and at least, for voiced sounds, long-term prediction operators which are estimated by analyzing decoded samples of a past decoded signal, said decoded samples being stored previously when transmitted data corresponding to said past decoded signal are valid; and controlling an energy level of a synthesized signal generated from the synthesized sample by means of a gain that is computed and adapted sample by sample in accordance with a gain adaptation relationship that depends on at least one of the stored decoded samples.

2. The method according to claim 1, wherein the gain for controlling the synthesized signal is calculated as a function of at least one of the following parameters: energy values previously stored for the samples corresponding to valid data, a fundamental period of the voiced sounds and a frequency spectrum characteristic.

3. The method according to claim 2, wherein the gain used to control the synthesized signal decreases progressively as a function of a duration during which synthesized samples are generated.

4. The method according to claim 1, further comprising:

distinguishing steady sounds and non-steady sounds in the valid transmitted data; and implementing gain adaptation relationships to control the synthesized signal that differ, firstly for samples generated following valid transmitted data corresponding to steady sounds and secondly for samples generated following valid transmitted data corresponding to non-steady sounds.

5. The method according to claim 1, further comprising:

updating a content of memories used for decoding as a function of generated synthesized samples.

6. The method according to claim 5, wherein the synthesized samples are subjected at least in part to coding analogous to that implemented at a transmitter of the digital signal, optionally followed by at least part of a decoding operation, with the data that is obtained serving to regenerate the memories of a decoder.

7. The method according to claim 1, further comprising:

generating an excitation signal for input to a short-term prediction operator;

wherein the generated excitation signal in a voiced zone is a sum of a harmonic component plus a weakly harmonic or non-harmonic component, and in a non-voiced zone is restricted to a non-harmonic component.

8. The method according to claim 7, wherein the harmonic component is obtained by implementing filtering based on applying the long-term prediction operator applied to a residual signal computed via inverse short-term filtering on the stored decoded samples.

9. The method according to claim 8, wherein the weakly harmonic or non-harmonic component is determined using a long-term prediction operator to which pseudo-random disturbances are applied.

10. The method according to claim 9, wherein in order to generate a voiced excitation signal, the harmonic component is limited to low frequencies of the spectrum, while the weakly harmonic or non-harmonic component is limited to high frequencies.

11. The method according to claim 8, wherein the residual signal is processed non-linearly to eliminate amplitude peaks.

12. The method according to claim 7, wherein in order to generate a voiced excitation signal, the harmonic component is limited to low frequencies of the spectrum, while the weakly harmonic or non-harmonic component is limited to high frequencies.

13. The method according to claim 7, wherein in order to generate a voiced excitation signal, the harmonic component is limited to low frequencies of the spectrum, while the weakly harmonic or non-harmonic component is limited to high frequencies.

14. The method according to claim 1, wherein voice activity is detected while estimating noise parameters, and wherein the parameters of the synthesized signal are processed such that they tend towards the estimated noise parameters.

15. The method according to claim 14, wherein a noise spectrum envelope of decoded samples is estimated and a synthesized signal is generated that tends towards a signal possessing the noise spectrum envelope.

16. Apparatus for concealing transmission error in a digital audio signal, the apparatus receiving as input a decoded signal applied thereto by a decoder, and the apparatus generating samples that are missing or erroneous in said decoded signal, wherein the apparatus comprises processor means configured to implement the method of claim 1.

17. A transmission system comprising at least a coder, at least one transmission channel, a module configured to detect whether transmitted data has been lost or is highly erroneous, at least one decoder, and apparatus for concealing errors which receives a decoded signal, wherein the apparatus for concealing errors is the apparatus according to claim 16.

* * * * *